US005287912A

United States Patent [19]

Folder et al.

[11] Patent Number: 5,287,912

[45] Date of Patent: Feb. 22, 1994

[54] STRIP CASTING

[75] Inventors: William J. Folder, Kiama Downs; Lloyd W. Townsend; Hisahiko Fukase, both of Wollongong, all of Australia

[73] Assignees: Ishikawajima-Harima Heavy Industries Company Limited, Tokyo, Japan; John Lysaght (Australia) Limited, New South Wales, Australia

[21] Appl. No.: 970,209

[22] Filed: Nov. 2, 1992

[30] Foreign Application Priority Data

Nov. 21, 1991 [AU] Australia ..... PK9598

[51] Int. Cl.[5] ..... B22D 11/06; B22D 11/08

[52] U.S. Cl. ..... 164/480; 164/483; 164/428

[58] Field of Search ..... 164/428, 480, 483

[56] References Cited

FOREIGN PATENT DOCUMENTS 58-218357 12/1983 Japan ..... 164/428

61-232043 10/1986 Japan ..... 164/483

*Primary Examiner*—Kuang Y. Lin

*Attorney, Agent, or Firm*—Nikaido, Marmelstein, Murray & Oram

[57] ABSTRACT

Method and apparatus for casting metal strip in which molten metal is introduced between a pair of parallel casting rollers (16) via a tundish (18) and metal delivery nozzle (19). Casting rollers (16) are cooled so that shells solidify on the moving roller surfaces and are brought together at the nip between them to produce a solidified strip product (20) at the roller outlet. A clean head end of the strip (20) is formed by adjusting the nip of the casting rollers to form a transverse bulge (103) across the width of the strip. The two separate solidified metal shells (105) and defines a line of weakness across the width of the strip. The strip separates at the line of weakness to form a clean head end for the following strip.

10 Claims, 7 Drawing Sheets

STRIP CASTING

TECHNICAL FIELD

This invention relates to the casting of metal strip. It has particular but not exclusive application to the casting of ferrous metal strip.

It is known to cast non-ferrous metal such as aluminium by continuous casting in a twin roll caster. Hot metal is introduced between a pair of contra-rotated horizontal casting rollers which are cooled so that metal shells solidify on the moving roller surfaces and are brought together at the nip between them to produce a solidified strip product at the outlet from the roller nip. The hot metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the need to form a clean head end at the commencement of casting so that the metal strip can be taken directly onto a coiler or other take-up device. The present invention provides an improvement whereby this problem can be overcome.

DISCLOSURE OF THE INVENTION

According to the invention there is provided a method of casting metal strip of the kind in which molten metal is introduced between a pair of parallel casting rollers via a tundish and a metal delivery nozzle, wherein a clean head end of the cast metal strip is formed by adjusting the nip of the casting rollers to form a bulge in the cast metal strip which comprises molten metal enclosed between solidified metal shells formed on the casting rollers and defines a line of the weakness across the width of the cast metal strip whereby the cast metal strip separates into a downstream section and an upstream section at the line of weakness as the cast metal strip moves from the nip of the casting rollers.

Preferably, the nip is adjusted by quickly moving one or both casting rollers outwardly and then inwardly.

More preferably, the nip is adjusted by quickly moving both casting rollers outwardly and then inwardly.

BRIEF DESCRIPTION OF THE DRAWINGS

In order that the invention may be more fully explained, one particular form of apparatus and its operation will now be described in some detail with reference to the accompanying drawings in which.

BEST MODE OF CARRYING OUT THE INVENTION

Figure 1:
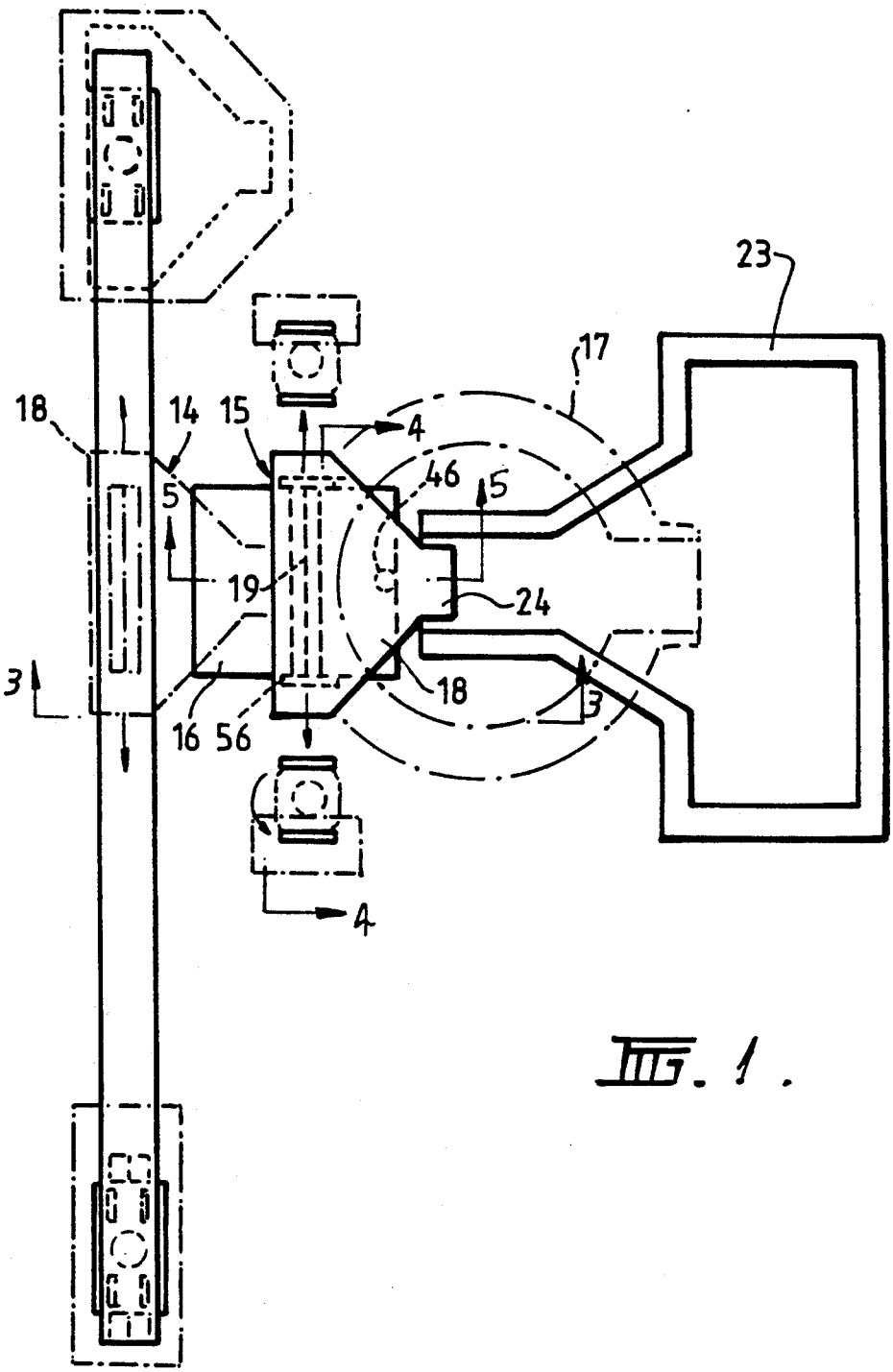
FIG. 1 is a plan view of a continuous strip caster constructed to operate in accordance with the invention.
Figure 2:
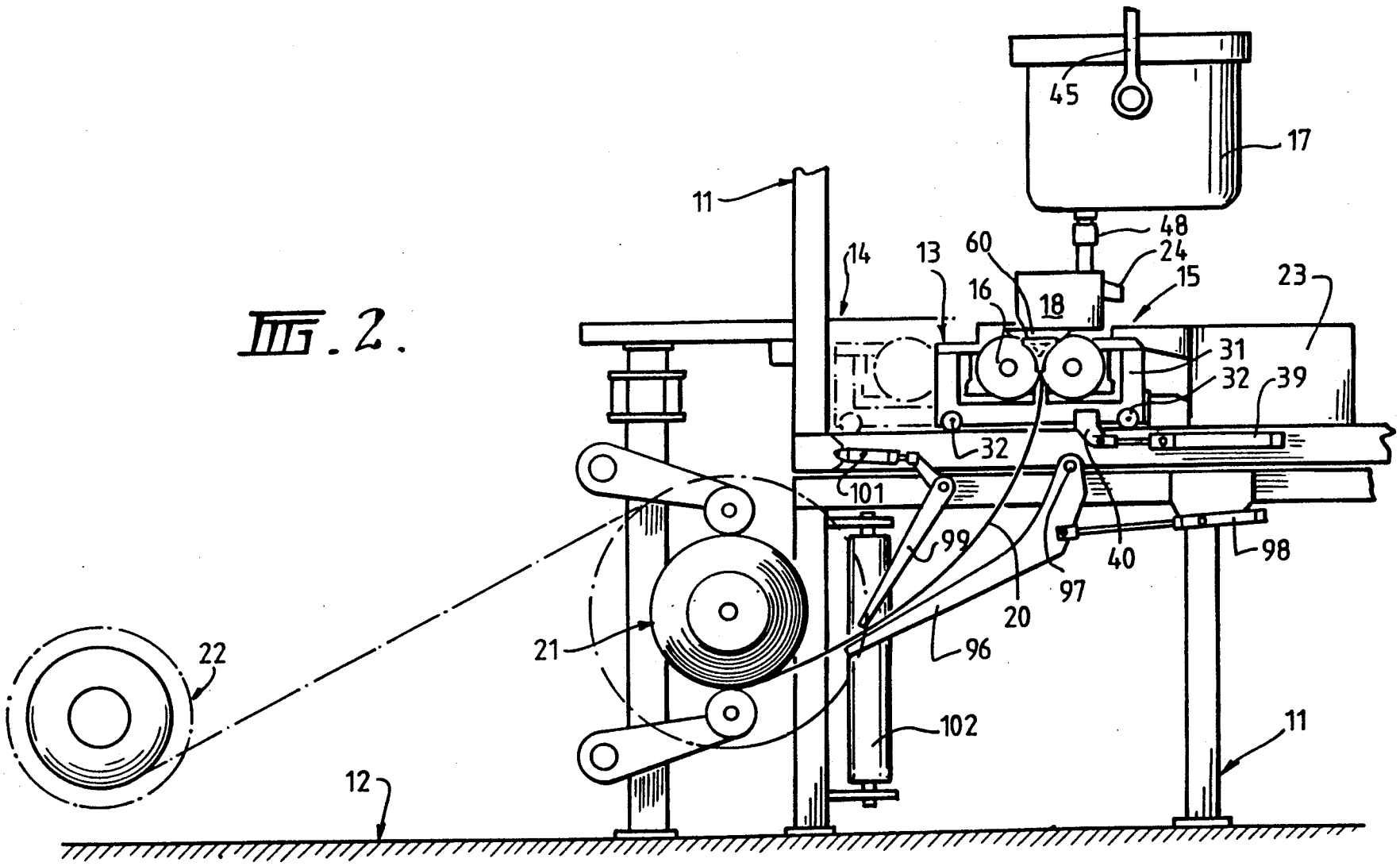
FIG. 2 is a side elevation of the strip caster shown in FIG. 1.
Figure 3:
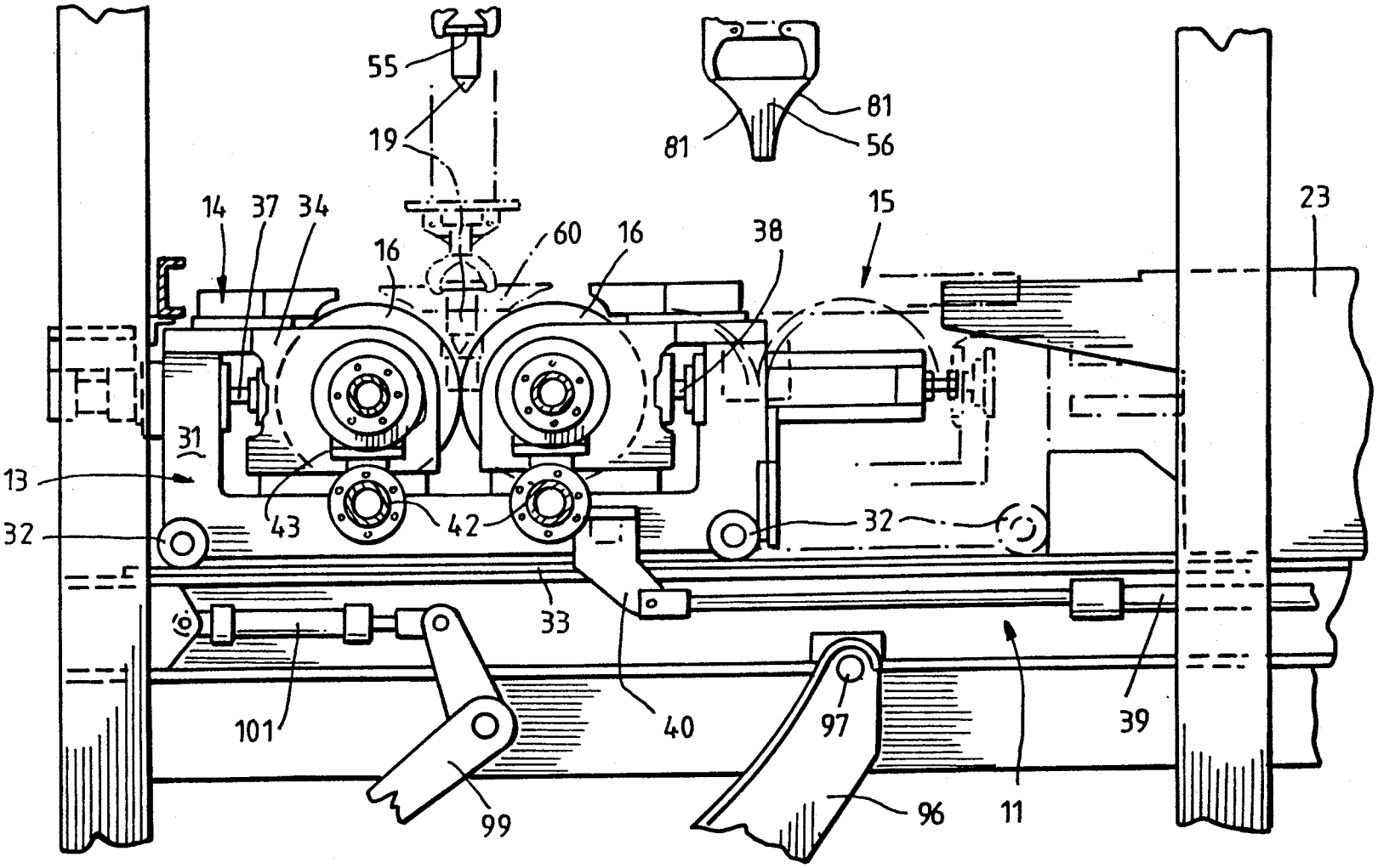
FIG. 3 is a vertical cross-section on the line 3—3 in FIG. 1.
Figure 4:
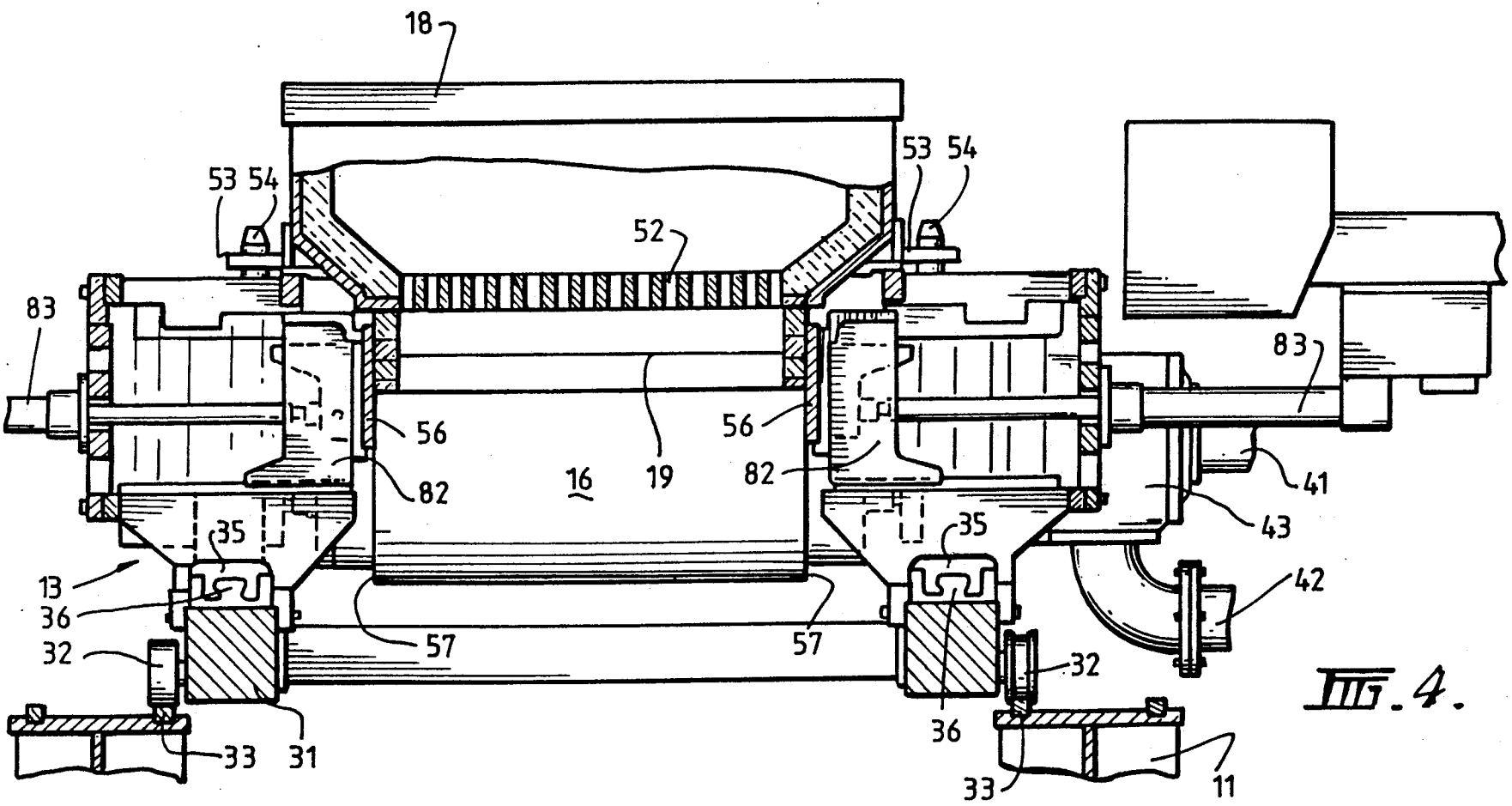
FIG. 4 is a vertical cross section on the line 4—4 in FIG. 1.
Figure 5:
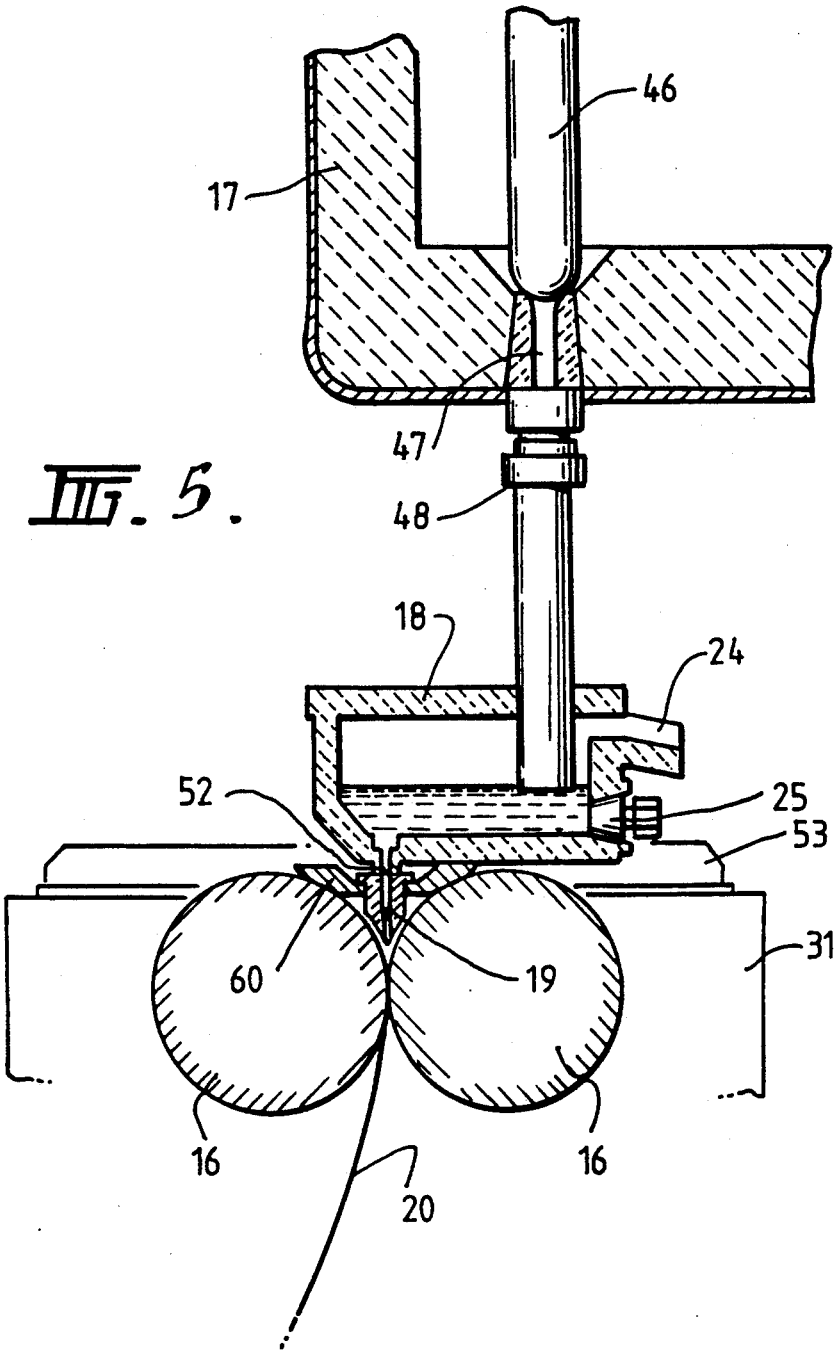
FIG. 5 is a vertical cross-section on the line 5—5 of FIG. 1.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles 34 in which the rollers 16 are rotatably mounted. Roller cradles 34 are mounted on the carriage frame 31 by interengaging complementary slide members 35, 36 to allow the cradles to be moved on the carriage under the influence of hydraulic cylinder units 37, 38 to adjust the nip between the casting rollers 16 and to enable the rollers to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and vice versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The roller may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rollers 16. It is provided with a mounting bracket 60 whereby to support it on the roller carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rollers and to deliver the molten metal into the nip between the rollers without direct impingement on the roller surfaces at which initial solidification occurs. Alternatively, the nozzle may have a single continuous slot outlet to deliver a low velocity curtain of molten metal directly into the nip between the rollers and/or it may be immersed in the molten metal pool.

The pool is confined at the ends of the rollers by a pair of side closure plates 56 which are held against stepped ends 57 of the rollers when the roller carriage is at the casting station. Side closure plates 56 are made of a strong refractory material, for example boron nitride, and have scalloped side edges 81 to match the curvature of the stepped ends 57 of the rollers. The side plates can be mounted in plate holders 82 which are movable at the casting station by actuation of a pair of hydraulic cylinder units 83 to bring the side plates into engagement with the stepped ends of the casting rollers to form end closures for the molten pool of metal formed on the casting rollers during a casting operation.

During a casting operation the ladle stopper rod 46 is actuated to allow molten metal to pour from the ladle to the tundish through the metal delivery nozzle whence it flows to the casting rollers. After a clean head end of the strip product 20 is produced in the manner to be described below, that head end is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Figure 6:
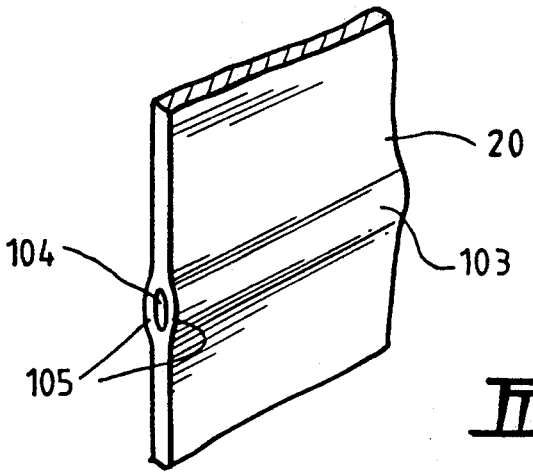
FIG. 6 illustrates the manner in which a line of weakness is generated across the width of metal strip produced by the caster to produce a clean head end of the strip.

In order to form a clean head end of the strip product 20, shortly after the leading section of the head end emerges from the nip between the casting rollers 16 the hydraulic cylinder units 37, 38, which are operatively connected to the roller cradles 34, are actuated to move the casting rollers 16 quickly away from and then towards each other to adjust the nip between the casting rollers 16 so that a transverse bulge 103 is formed across the width of the strip product 20 as illustrated in FIG. 6. The bulge comprises a molten metal core 104 confined between two separated solidified metal shells 105 formed on the casting rollers 16 during the short time interval that the nip between them is widened. As the molten metal core 104 solidifies it transmits heat to the shells 105 causing them to partially re-melt. Because of this re-melting and the brittle nature of steel at high temperatures a distinct line of weakness is formed across the strip product at the bulge. This line is sharply defined and extends in straight across the strip at the location of the crests of the bulge. The weakening of the strip is such that the average tensile strength of the strip at the line of weakness is insufficient to support the weight of the short segment of the strip produced before the bulge is formed. This segment therefore separates from the strip at the line of weakness and drops to the floor to leave a clean head end to be taken onto the coiler 21.

Figure 7:
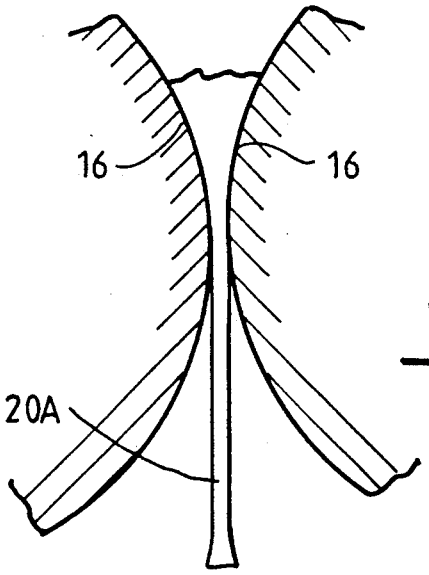
FIGS. 7 to 10 show diagrammatically successive steps in the formation of the clean head end of the cast strip in accordance with the invention.
Figure 8:
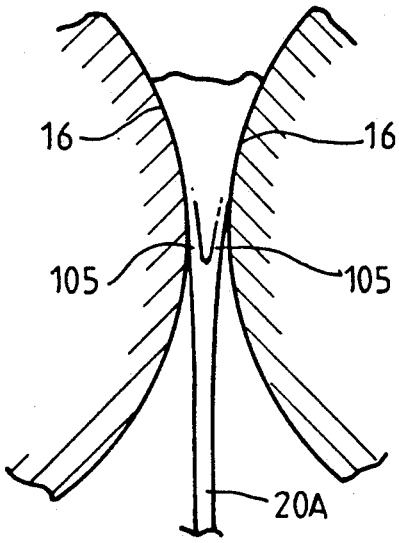
Figure 9:
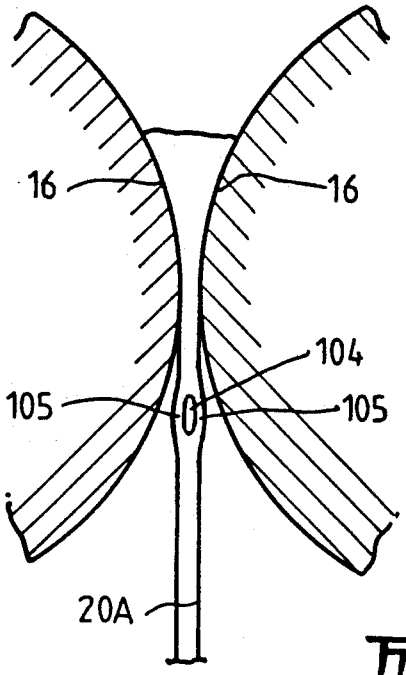
Figure 10:
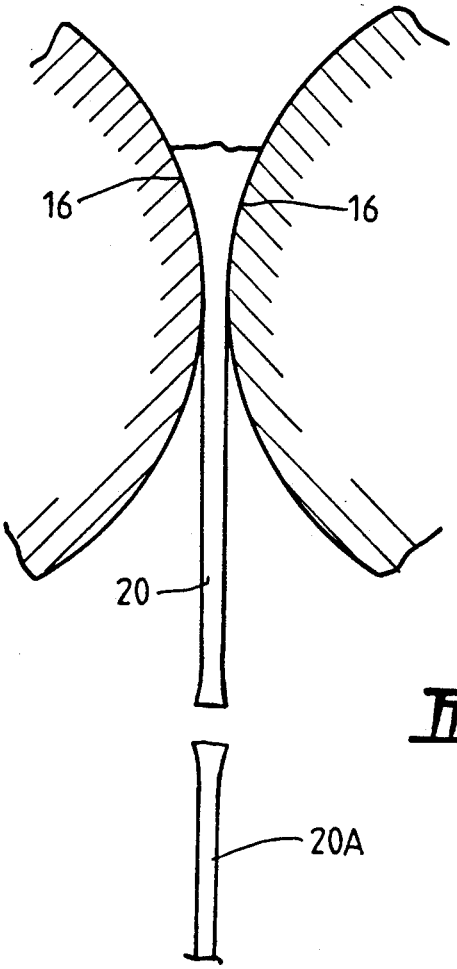

FIGS. 7 to 10 illustrate diagrammatically successive steps in the formation of the clean head-end of the cast strip. FIG. 7 shows the casting rollers 16 arranged at normal spacing to produce a leading strip segment 20A. FIG. 8 shows the rollers moved apart to approximately double the spacing between them whereby to produce the leading ends of the separated solidified shells 105. FIG. 9 shows the casting rollers 16 brought back to their normal separation so as to complete formation of the bulge with the separated cylindrical shells 105 and the molten core 104. FIG. 10 shows the separation of the lead segment 20A from the strip product 20 as the molten core 104 solidifies so as to produce a straight and sharp edged head end for the strip product 20.

In order to achieve the sequence of steps illustrated in FIGS. 7 to 10, it is necessary that the casting rollers 16 be separated to such an extent and over such a time interval as to maintain continuity of production of the strip product whilst at the same time producing a sufficiently large bulge to weaken the strip as the molten core of the bulge solidifies to cause the short initial strip segment 20A to drop away at the line of weakness created by the bulge. It has been found in practice that the increased spacing between the casting rollers for formation of the bulge should be in the range 1.5 to 2.5 times the thickness of the strip product and that a doubling of the nip spacing is generally satisfactory. Thus, in casting a steel strip product of 2 mm thickness the spacing between the casting rollers will be opened to produce a maximum gap of 4 mm during formation of the bulge across the strip. It is also been found that for best results the width of the bulge in the longitudinal direction of the strip should be in the range 20 to 30 mm. In a typical caster the strip may be produced at the rate of about 30 metres per minute so that the casting rollers must be separated and re-closed through a short time interval of the order of 60 milliseconds. This is readily achievable with standard hydraulic controls for controlling the operation of the hydraulic cylinder units 37, 38.

The illustrated apparatus and its sequence of operation have been described by way of example only and the invention is not limited to any of the described constructional or operational details. Moreover, the invention is not limited in its application to the formation of a clean head end at the commencement of a casting run. It may be employed part-way through a casting run in the event of an accidental breakage in the cast strip or when it is desired to transfer the strip being cast to a new coiler. It is accordingly to be understood that many modifications and variations will fall within the scope of the appended claims.

I claim:

1. In a method of forming metal strip which comprises:

introducing molten metal into the nip of a contra-rotating pair of casting rollers which are contra rotating about axes;

cooling said rollers an amount sufficient to cause the portion of said molten metal in contact therewith to solidify into shells;

forming a strip, comprising said shells and molten metal therebetween, in the nip between said cooled rollers; and moving said strip out of said nip as a substantially continuous strip to form a substantially solid metal strip;

the improvement which comprises:

after a portion of said strip has passed through said nip and has been formed into a strip of substantially solidified metal, moving at least one of said rollers radially away from the other of said rollers an amount sufficient to increase the thickness of said nip, and then moving said roller radially toward the other an amount sufficient to decrease the thickness of said nip, whereby forming a transversely thickened area in said formed sheet wherein the surface portions of said thickened area are substantially solid, and the interior portion of said thickened area is substantially molten whereby causing said transverse area to become reduced in tensile strength; and causing said strip to separate along said area of reduced tensile strength thereby forming two portions of case strip of substantially solidified metal, at least one of which has a substantially clean end thereon.

2. An improved method as claimed in claim 1 where both of said rollers are moved radially apart and then moved radially together.

3. An improved method as claimed in claim 1 wherein said transverse thickened area is produced by increasing the size of said nip to about 1.5 to 2.5 times the size of said nip during formation of the remainder of said strip.

4. An improved method as claimed in claim 3 wherein said nip size is increased to about twice.

5. An improved method as claimed in claim 1 wherein said transverse thickened area is about 20 to 30 mm in longitudinal length.

6. An improved method as claimed in claim 1 including the further step of winding said cast metal strip on coiling means into a roll thereof.

7. An improved method as claimed in claim 6 including forming said transverse thickened area, said separating said cast strip portions prior to winding said strip.

8. An improved method as claimed in claim 1 including causing said strip to separate along said thickened area by causing a downstream portion of said strip, weighing more than the tensile strength of said strip in said thickened area, to be supported by said thickened area.

9. An improved method as claimed in claim 8 wherein said downstream portion of said strip is caused to hang downward whereby being supported substantially solely by said thickened area.

10. An improved method as claimed in claim 7 further including guiding said clean end of said strip into effective contact with said coiling means.

* * * * *